United States Patent [19]

Manaugh

[11] 3,990,589

[45] Nov. 9, 1976

[54] PARKING APPARATUS WITH BARRIERS IN THE STORAGE STALLS THAT ARE ACTUATED BY A VEHICLE TRANSFER DOLLY

[76] Inventor: Carlisle F. Manaugh, 522 Arbramar Ave., Pacific Palisades, Calif. 90272

[22] Filed: Aug. 11, 1975

[21] Appl. No.: 603,338

[52] U.S. Cl. ..... 214/16.1 C; 214/16.1 EB

[51] Int. Cl.[2] ..... E04H 6/06

[58] Field of Search ..... 214/16.1 R, 16.1 EB, 214/16.4 A, 16.4 C, 16.4 B, 16.1 C, 16.1 CC, 16.1 CE, 16.1 DB

[56] References Cited

UNITED STATES PATENTS

| | | | |
|---|---|---|---|
| 1,508,921 | 9/1924 | Castleman | 214/16.1 DB |
| 1,869,046 | 7/1932 | Buck | 214/16.1 DB |
| 2,095,151 | 10/1937 | O'Connor et al. | 214/16.4 C |
| 2,714,456 | 8/1955 | Manaugh | 214/16.1 EB |
| 2,741,859 | 4/1956 | Castle | 214/16.1 R |
| 3,088,605 | 5/1963 | Martinson | 214/16.1 DB |
| 3,880,299 | 4/1975 | Zollinger et al. | 214/16.4 B |

FOREIGN PATENTS OR APPLICATIONS

| | | | |
|---|---|---|---|
| 1,931,792 | 9/1970 | Germany | 214/16.4 B |

*Primary Examiner*—Frank E. Werner
*Assistant Examiner*—R. B. Johnson
*Attorney, Agent, or Firm*—Keith D. Beecher; Jessup & Beecher

[57] ABSTRACT

A multiple story parking apparatus has rows of storage stalls on each upper floor which are separated by a crane-way. A horizontally movable elevator is mounted in each of the crane-ways. A self-propelled traverse dolly is carried on the elevator platform, and the dolly moves in and out of the various stalls to deposit the cars in the stalls and to retrieve the cars from the stalls. The stalls in the center storage unit are open at both ends to the adjacent crane-ways, so that cars may be loaded into the center storage unit from each end. In order to prevent dollies entering one end of the stalls of the center unit from moving through the other end and falling to the ground, springloaded pivotally mounted barrier are provided at the two ends of each of the stalls in the center storage unit. Each barrier is turned down by the dolly as it enters the stall from one end and is held down by the folly until the dolly has deposited the car in the stall, or has picked up the car from the stall, and has returned to the elevator platform. However, when the dolly returns to the elevator platform through that end, the individual barrier springs up to an upright position to prevent a dolly entering the other end of the stall from going through the first-mentioned end.

8 Claims, 5 Drawing Figures

PARKING APPARATUS WITH BARRIERS IN THE STORAGE STALLS THAT ARE ACTUATED BY A VEHICLE TRANSFER DOLLY

BACKGROUND OF THE INVENTION

U.S. Pat. No. 2,714,456, which issued Aug. 2, 1955, to the present inventor, describes a car parking system which comprises three spaced and parallel, multiple story parking units with suitable craneways therebetween for storing a large number of cars in individual stalls on each story of each unit. As pointed out in the patent, mechanical parking systems are known in which cars are loaded by suitable crane mechanisms in stalls arranged on multiple tiers. The prior art systems generally utilize a crane-way running between two multiple story parking structures, and each structure has a row of stalls on each story to receive the cars from the elevators which move horizontally and vertically in the crane-ways.

The storage system described in the patent, comprises three multi-story parking units extending transversely across a parking lot in parallel with one another and spaced from one another longitudinally of the lot by suitable crane-ways.

Each parking unit disclosed in the patent comprises a ground story and a number of upper stories above the ground story. The parking units are of substantially rectangular shape, and each includes a longitudinal row of stalls extending along each story and open at their ends to the crane-ways. Elevator mechanisms are mounted in the crane-ways, and the elevator mechanisms are adapted to move vertically and horizontally to service the various stalls on each story of the various parking units.

The elevator mechanism in the first crane-way services both the first parking unit and the center parking unit, while the elevator in the second crane-way services both the center parking unit and the third parking unit. Therefore, the center parking unit may be loaded from each end, and its stalls extend from one end of the unit to the other, and each of its stalls is open at both ends. This creates a problem, in that a dolly entering a stall from one end by the first elevator mechanism may inadvertently move completely through the stall and fall through the other end.

The present invention provides a carrier mechanism which is intended to prevent such a happening. The barrier mechanism to be described comprises a spring-loaded barrier mounted at each end of each stall in the center parking or storage unit. Each barrier may be turned inwardly from its upright position by the dolly, as the dolly enters the stall from the corresponding elevator platform to deposit a car in the stall. The particular barrier at the end at which the dolly entered the stall is held down by the dolly until the car is deposited in the stall and until the dolly is returned to the elevator mechanism. Then the barrier springs up to an upright position, so that a dolly entering the stall from the other end is prevented from moving through the first end.

The car may be retrieved from either end of the stall by the dollies on the first or second elevator mechanism, since the dollies may enter the stall from either end, and thereby turn down the barrier at that end and hold the barrier down until it has retrieved the car and has returned to the elevator. In each case the dolly is prevented from passing through the other end.

DETAILED DESCRIPTION OF THE ILLUSTRATED EMBODIMENT

Figure 1:
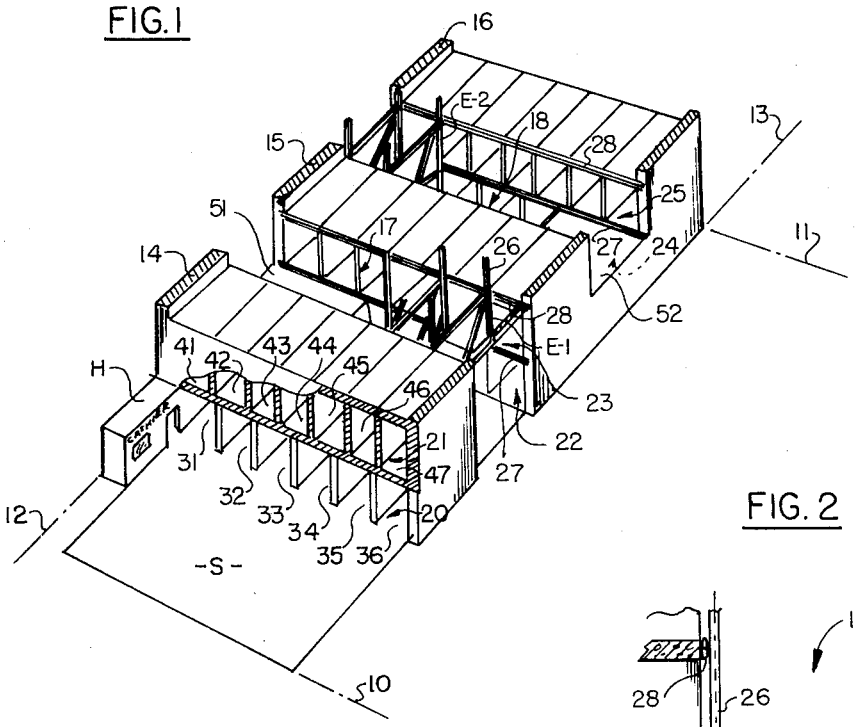
FIG. 1 is a diagrammatic perspective view of a portion of an illustrative car parking system of the type described in the aforesaid patent.

Referring to FIG. 1, there is shown a parking lot bounded on its front by the boundary line 10 and at its rear by the boundary line 11. The sides of the lot are confined by the boundary lines 12 and 13. By way of example, the dimensions of the lot shown in FIG. 1 may be 60 feet by 140 feet, as indicated. This size lot is somewhat narrower than the conventional area employed in downtown sections for parking automobiles.

In a preferred layout, the parking system of FIG. 1, includes an open area or space S at the front entrance for manipulating cars. The construction itself is divided into three parallel structural multi-story parking storage units 14, 15 and 16 of generally rectangular shape as seen in plan view, disposed transversely of the lot and spaced from one another longitudinally of the lot. Between the first, or forward, and second, or center, units 14 and 15 there is provided a first crane-way 17; and between the center and third, or rear, units 15 and 16 there is provided a second crane-way 18. As shown in FIG. 1, the crane-way 17 accommodates an elevator mechanism E1 adapted to move vertically and horizontally within the crane-way as indicated by the arrows. Crane-way 18 accommodates a similar elevator mechanism E2.

The first multi-story car storage unit 14 comprises a ground story 20 and multiple tiers, or upper stories, only one of which is shown at 21 for simplicity purposes. Similarly, the second and third parking storage units, respectively, include a ground story 22, a first tier or upper story 23, and other upper stories, not shown; and a ground story 24, a first tier or upper story 25, and other upper stories, not shown. Thus, while only one upper story has been shown above each of the ground stories 20, 22 and 24, it is to be understood that any number of upper stories may be provided for each parking storage unit. Also, it is to be understood that any number of parallel parking units may be provided, spaced by further crane-ways, the three units being shown for illustrative purposes only.

Figure 2:
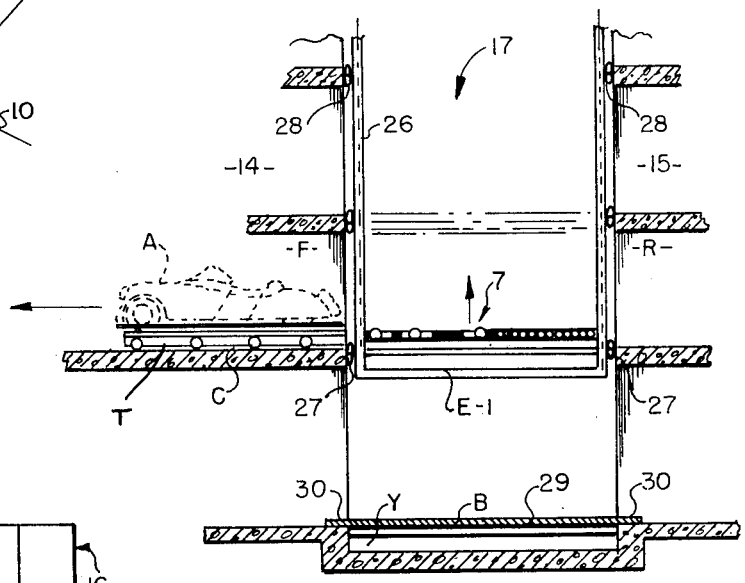
FIG. 2 is an enlarged elevational view showing the manner of operation of an elevator mechanism in one of the craneways, and also showing a self-propelled traverse dolly carried by the elevator platform for moving cars into and out of each of the stalls in the multi-story parking units serviced by the elevator mechanism.

As shown in greater detail in FIG. 2, the elevator mechanism E1 in the crane-way 17 is suspended from the second story of the first and second storage units 14 and 15. Mounted on the elevator is a self-propelled traverse dolly T embodying a carriage C adapted to reach under a car A, lift it up, and move it onto the elevator platform; and then, to reach out into a stall, deposit the car on the stall floor, and return to the elevator. Suitable self-propelled traverse dollies are described, for example in copending application Ser. No. 490,274, filed July 22, 1974. The dolly moves transversely from the elevator platform into the selected stall so that an automobile, as shown at A, may be deposited in either a front stall F or a rear stall R, in one or the other of the two units; and so that the automobile may be subsequently retrieved from the stall by a reverse operation of the dolly.

The platform 7 of the elevator mechanism El is adapted to ride vertically in a supporting frame 26 disposed in the craneway 17 to carry its traverse dolly to the upper stories of the storage units. Frame 26 is in turn mounted for horizontal movement at its lower end on rails 27 extending longitudinally along the sides of the crane-way at any level above the first story, and rails 28 similarly longitudinally extending along the sides of the crane-way at a higher level.

As shown in FIG. 1, the ground story 20 of the first storage unit 18 comprises six entrance stalls 31, 32, 33, 34, 35 and 36. The first story of the first storage unit 14 has seven stalls 41, 42, 43, 44, 45, 46, and 47. Cars to be parked enter the lot across the front border 10 and drive directly into any one of the stalls 31, 32, 33, 34, 35 or 36 in the ground story of the front storage unit 14. Any cars driven into the stalls 31, 32, 33, 34, 35 or 36 may be picked up by the dolly T on the elevator El of crane-way 17 and deposited in any of the stalls in either of the storage units 14 or 15. After these cars have been removed, further cars may be driven into the pick-up stalls 31, 32, 33, 34, 35 and 36, and similarly parked by the elevator E1 in the crane-way 17. The parked cars in storage unit 15 may be picked up by a similar dolly on the elevator E2 in crane-way 18 and deposited in stalls in either of the storage units 15 or 16.

To unload a car from a particular stall in any one of the upper stories of the storage units 14, 15 and 16, the appropriate elevator mechanisms E1 and E2 in crane-way 17 or 18 are employed to lower the car to the ground floor. As an example, the elevator mechanism E1 in crane-way 17 may pick up a car in any stall in storage units 14 or 15, or the elevator E2 in crane-way 18 may pick up a car from any stall in storage units 15 or 16, and lower it to the ground story in position opposite any one of four exit stalls in the rear storage unit, and the customer may then drive the car out of the rear of the structure. Ramps, such as ramp 29 may be provided to permit cars to be driven over the elevator pits in the crane-ways.

Figure 3:
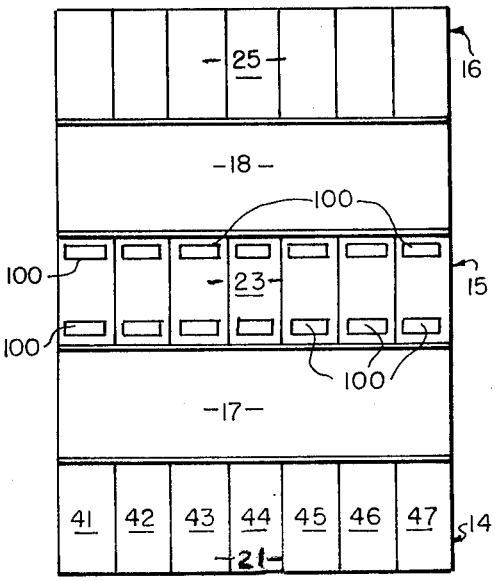
FIG. 3 is a schematic plan view of the parking stalls in one of the upper stories of one of the parking units of the system, and of the barriers mounted at each end of the stalls in the center parking unit.

FIG. 3 shows a plan view of the first stories 21, 23 and 25 of the three multi-story car parking storage units 14, 15 and 16. As shown, each story accommodates a row of seven stalls, the stalls on story 21 being designated 41, 42, 43, 44, 45, 46 and 47, as also shown in FIG. 1. The elevator mechanism in the crane-ways 17 and 18 may move the full length of the adjacent storage units to service any one of the stalls in the various stories thereof.

It will be seen from FIG. 3 that the center storage unit 15 is serviced by the elevators in both the crane-ways 17 and 18 and, for that reason, the stalls on the upper stories of the center storage unit are open at each end. Unless appropriate precautionary steps are taken, it is possible for a dolly entering one of the stalls in the center storage unit 15 from one end to inadvertently move through the other end and fall into the other crane-way. The present invention provides a series of barriers 100 at each end of each of the stalls of the center storage unit 15 to prevent such a happening.

The barriers, in one embodiment of the invention, are spring-loaded to an upright position, and each may be turned inwardly with respect to the corresponding stall. However, appropriate stops are provided so that the barriers may be incapable of turning outwardly. Therefore, when a traverse dolly from the elevator mechanism E1 or E2 in either the crane-way 17 or 18 carries a car into one of the stalls in the center storage unit 15, it turns down the corresponding barrier and holds the barrier down until it has deposited the car in the stall. The dolly can then move back onto its elevator, after which the corresponding barrier 100 springs up to its upright position. The barrier then serves to prevent a dolly entering the other end of the stall from moving out through the first end. However, a dolly can subsequently enter either end of the stall to remove the car, the dolly turning down the corresponding barrier 100 as it enters the stall.

Figure 4:
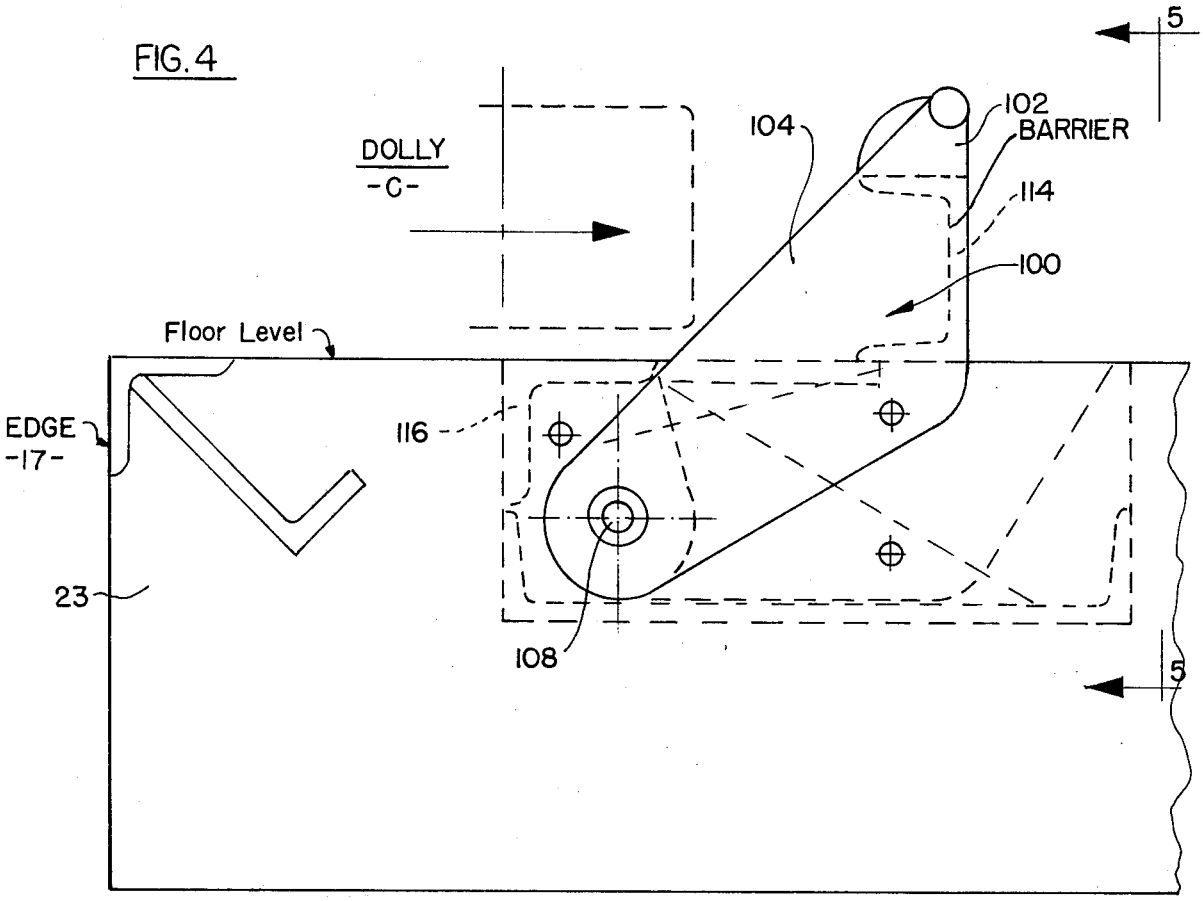
FIG. 4 is a side view of a barrier mechanism which may be mounted at each end of each of the stalls of the center parking unit.
Figure 5:
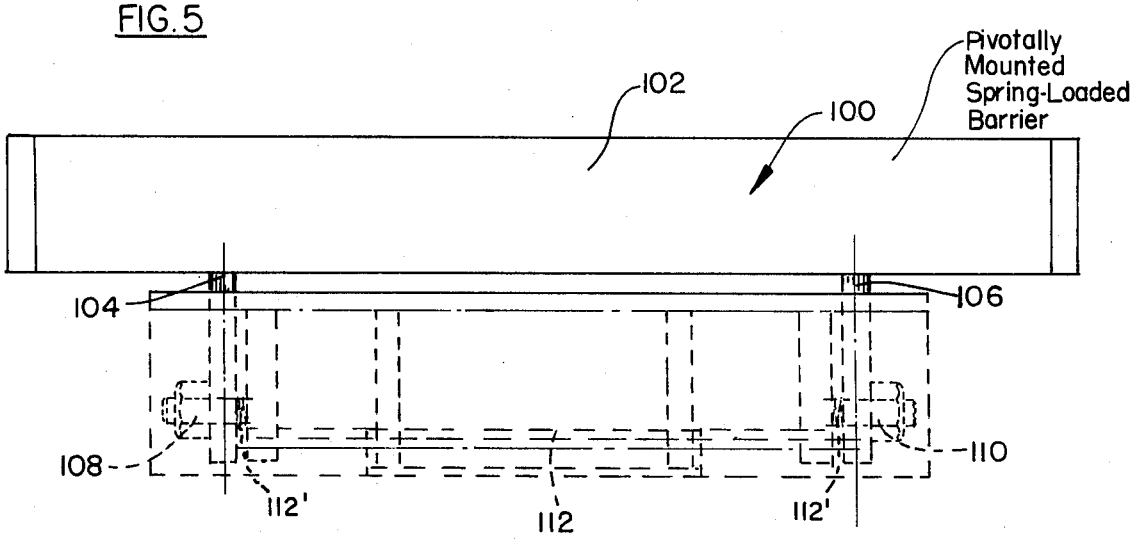
FIG. 5 is an end view of the barrier of FIG. 4, taken essentially along the line 5—5 of FIG. 4.

Details of the barrier mechanism 100 in one of its embodiments are shown, for example, in FIGS. 4 and 5. As illustrated, the barrier mechanism 100 includes an elongated pivotally mounted spring-loaded barrier member 102 which is supported by a pair of end brackets 104, 106. The end bracket 104 is pivotally mounted on a shaft 108, and the bracket 106 is pivotally mounted on a shaft 110. The shafts 108 and 110 are supported in a pit in the end of the corresponding stall by a frame 112 which is securely mounted within the pit.

As shown in FIG. 4, the barrier 102 is reinforced by an elongated beam 114 which is formed of steel, or other appropriate material. A further beam 116 is mounted in the pit, and extends the length of the pit to act as a stop to prevent the barrier from turning outwardly with respect to the corresponding stall. Appropriate torsion springs 112' are provided around the shafts 108, 110 to bias the barrier member 102 in a counterclockwise direction, as shown in FIG. 4, into its upright position against the stop beam 116.

As also shown in FIG. 4, when the dolly T enters the stall from, for example, the crane-way 17, it moves against the barrier 102 and causes it to turn down into the pit, to an essentially flush position with respect to the floor of the stall, permitting the dolly to enter the stall. The barrier is held down by the dolly, until the dolly has deposited the car, and thereafter the dolly moves back to the elevator. The barrier then springs up to its upright position, shown in FIGS. 4 and 5, so as to prevent a dolly entering the still from crane-way 18 from moving out through the other end of the stall and falling into crane-way 17. However, the dollies may subsequently enter the stall from either end of the stall to retrieve the car, moving the barrier member 102 down to its flush position as they enter the stall.

The invention provides, therefore, an improved parking system and structure, which incorporates safety means on the upper stories of at least its center storage unit, so as to prevent cars from inadvertently rolling out the otherwise open ends of the parking stalls.

It will be appreciated, that although a particular embodiment of the invention has been shown and described, modifications may be made. It is intended in the claims to cover all modifications which come within the spirit and scope of the invention.

What is claimed is:

1. In a multiple story mechanical car parking system for storing cars on building lot area, the combination of: a plurality of at least three parallel multiple story storge units extending transversely across said lot area in spaced relation to one another, including a front storage unit, a center storage unit, and a rear storage unit, said storage units defining crane-ways in the spaces therebetween extending transversely of said lot area and vertically upwards from the ground level, each of said storage units having on its stories above the ground level rows of adjacent storage stalls opening to adjacent crane-ways, with the stalls in the center storage unit being open at both ends to the adjacent crane-ways, an elevator mechanism mounted in each of the crane-ways for longitudinal horizontal movement therein and including an elevator platform mounted for vertical movement in said elevator mechanism, a moveable traverse dolly carried by the elevator platform of each elevator mechanism for depositing cars into the stalls and for retrieving cars from the stalls, and movable barrier mechanisms mounted at the ends of at least some of said stalls selectively engageable by said traverse dolly and held in a position thereby to permit movement of the traverse dolly into and out of the stalls from an adjacent crane-way and to prevent movement of the dolly through the opposite end of the stall from the end it entered.

2. The combination defined in claim 1, in which such barrier mechanisms are mounted at each end of each of the stalls of the intermediate storage unit.

3. The combination defined in claim 1, in which such barrier mechanisms each include an upright elongated barrier member extending across the stall and pivotally mounted to be turned down inwardly with respect to the stall from its upright position to a position essentially flush with the floor of the stall.

4. The combination defined in claim 1, in which each of the barrier mechanisms includes an elongated pivotally mounted upright barrier member extending across the stall, and stop means to prevent the barrier from being turned down from the upright position outwardly with resepct to the corresponding stall.

5. The combination defined in claim 4, and which includes spring means for biasing the barrier member to its upright position against the stop means.

6. In a multiple story mechanical car parking system for storing cars on a building lot area, the combination of: at least one storage unit having a crane-way extending across the face thereon, and having rows of adjacent storage stalls on each of its stories opening to the crane-way, an elevator mechanism mounted in the crane-way for longitudinal movement therein and including an elevator platform mounted in the elevator mechanism for vertical movement therein, a movable traverse dolly carried by the elevator platform for depositing cars in storage stalls and for retrieving cars from such stalls, and a movable barrier mechanism mounted at at least one end of at each of said stalls selectively engageable by said traverse dolly and held in a position thereby to permit movement of the traverse dolly into and out of the stall and to prevent movement of the dolly out of the opposite end of the stall from the end it entered.

7. The combination defined in claim 6, in which the barrier mechanism includes a barrier member extending transversely of the stall and pivotally mounted to be turned inwardly with respect to the stall down from an upright position to a position essentially flush with the surface of the stall, and stop means included in the barrier mechanism to prevent the barrier member from being turned down from the upright position outwardly with respect to the stall.

8. The combination defined in claim 7, and which includes spring means for biasing the barrier member to its upright position against the stop means.

* * * * *